US008899690B2

(12) United States Patent
Kötting et al.

(10) Patent No.: US 8,899,690 B2
(45) Date of Patent: Dec. 2, 2014

(54) SCRAPER DEVICE, AS WELL AS CONSTRUCTION MACHINE

(71) Applicant: Wirtgen GmbH, Windhagen (DE)

(72) Inventors: Heinz Kötting, Neustadt/Wied (DE); Herbert Ley, St. Katharinen (DE); Günter Hähn, Königswinter (DE)

(73) Assignee: Wirtgen GmbH (DE)

( * ) Notice: Subject to any disclaimer, the term of this patent is extended or adjusted under 35 U.S.C. 154(b) by 0 days.

(21) Appl. No.: 13/747,877

(22) Filed: Jan. 23, 2013

(65) Prior Publication Data

US 2013/0154340 A1 Jun. 20, 2013

Related U.S. Application Data

(63) Continuation of application No. 13/340,395, filed on Dec. 29, 2011, now Pat. No. 8,376,469, which is a continuation of application No. 12/222,623, filed on Aug. 13, 2008, now Pat. No. 8,100,480.

(30) Foreign Application Priority Data

Aug. 15, 2007 (DE) ..... 10 2007 038 677

(51) Int. Cl.

| | |
|---|---|
| ***E01C 19/00*** | (2006.01) |
| ***E01C 23/088*** | (2006.01) |
| ***E02F 3/78*** | (2006.01) |
| ***E02F 3/76*** | (2006.01) |
| ***E01C 23/12*** | (2006.01) |

(52) U.S. Cl.

CPC ..... *E01C 23/127* (2013.01); *E01C 23/088* (2013.01); *E02F 3/783* (2013.01); *E02F 3/7645* (2013.01)

USPC ..... 299/1.5; 299/39.6

(58) Field of Classification Search

USPC ..... 299/39.6, 39.2, 1.5; 404/118, 119

See application file for complete search history.

(56) References Cited

U.S. PATENT DOCUMENTS

| | | | |
|---|---|---|---|
| 3,091,999 | A | 6/1963 | MacDonald |
| 4,041,623 | A | 8/1977 | Miller et al. |

(Continued)

FOREIGN PATENT DOCUMENTS

| | | | |
|---|---|---|---|
| DE | 3405473 | A1 | 10/1985 |
| DE | 3528038 | A1 | 2/1987 |

(Continued)

OTHER PUBLICATIONS

European Search Report EP 08 15 9106, dated Sep. 24, 2010, 3 pages.

(Continued)

*Primary Examiner* — John Kreck

(74) *Attorney, Agent, or Firm* — Waddey & Patterson, P.C.; Lucian Wayne Beavers

(57) ABSTRACT

A scraper device for a milling drum mounted in a construction machine at a machine frame between lateral walls with a milling drum axis, with a two-part scraper blade arranged in a height-adjustable fashion behind the milling drum when seen in the direction of travel, the lower part of which can glide over the ground surface milled off by the milling drum, where the lower part of the scraper blade is adjustable in height when in operating position, it is provided that the upper part of the scraper blade is attached, at the upper end, to swivel about a swivelling axis parallel to the axis of the milling drum.

25 Claims, 5 Drawing Sheets

(56) References Cited

U.S. PATENT DOCUMENTS

| | | | | |
|---|---|---|---|---|
| 4,647,248 | A | 3/1987 | Wirtgen | |
| 4,723,867 | A | 2/1988 | Wirtgen | |
| 5,373,902 | A | 12/1994 | Lindblom | |
| 5,474,397 | A * | 12/1995 | Lyons | 299/39.5 |
| 5,505,598 | A | 4/1996 | Murray | |
| 6,923,508 | B2 | 8/2005 | Holl et al. | |
| 7,438,364 | B2 | 10/2008 | Boehme et al. | |
| 7,523,995 | B2 * | 4/2009 | Rio et al. | 299/39.6 |
| 8,100,480 | B2 | 1/2012 | Kötting et al. | |
| 2004/0075330 | A1 | 4/2004 | Holl et al. | |

FOREIGN PATENT DOCUMENTS

| | | | |
|---|---|---|---|
| DE | 20011942 | U1 | 11/2001 |
| DE | 102005058102 | B3 | 3/2007 |
| EP | 1408158 | A1 | 4/2004 |

OTHER PUBLICATIONS

Exhibit A: a group of 14 pages of photographs of a Caterpillar PM200 machine having a two part scraper blade. Applicant admits that the two part scraper blade design as seen in these photographs is a part of the prior art.

* cited by examiner

SCRAPER DEVICE, AS WELL AS CONSTRUCTION MACHINE

BACKGROUND OF THE INVENTION

The invention relates to a scraper device, as well as a construction machine.

A scraper device for a milling drum mounted in a construction machine at a machine frame in lateral walls, with a scraper blade arranged in a height-adjustable fashion behind the milling drum when seen in the direction of travel, is known from DE 10 2005 058 102. With this scraper device, the lower part of the scraper blade can glide over the ground surface milled off by the milling drum, with the scraper blade being guided in a height-adjustable fashion relative to the milling drum.

From DE 35 28 038, it is known in a scraper device with a single-part scraper blade to use a scraper blade capable of swivelling. A laterally arranged retaining groove causes the lifting movement of the scraper blade to turn into a swivelling movement towards the end of the path of a lifting cylinder.

It is also known from U.S. Pat. No. 5,505,598 and U.S. Pat. No. 5,474,397 to use the lifting cylinder for the swivelling movement, in which case it is necessary, however, to manually remove bolts for unlocking.

In the single-part scraper devices according to the state of the art mentioned above, access to the drum is achieved by means of a large lifting capacity of the scraper blade without swivelling.

In summary, the known state of the art has the following disadvantages:

- Lifting cylinders simultaneously designed for lifting as well as for swivelling have a too large design height,
- the swivelling radius is larger with these solutions, which requires the rear travel drive units to be arranged far towards the rear,
- manual removal of the bolts is time-consuming and requires effort,
- if one of the bolts gets jammed, it needs to be removed manually using a tool, which involves a lot of effort,
- the use of bolts has the disadvantage of a small contact surface, which results in a high surface pressure and high wear and tear,
- the achievable swivelling angle is too small,
- the design height of single-part scraper devices is so large that it is suitable only where the milling drum is arranged at the rear end of the construction machine, and not between the front axle and the rear axle below the machine frame.

It is therefore an object of the invention to create a scraper device, the scraper blade of which is capable of swivelling with a large swivelling angle at a small swivelling radius, which realizes a low design height and does not require manual operation.

The invention provides in an advantageous manner that the upper part of the scraper blade is attached, at the upper end, in an articulated fashion to swivel about a swivelling axis parallel to the axis of the milling drum, that the scraper blade, when in operating position, is engaged with lateral retaining devices in the lateral walls, which retain the scraper blade in a position running essentially orthogonally to the ground surface, that a swivelling device is capable of swivelling the scraper blade about the swivelling axis when the scraper blade is disengaged from the lateral retaining devices, and that the swivelling device, at the upper end of the upper scraper blade, is provided with an operating device articulated between a permanently installed part of the construction machine and the upper part of the scraper blade.

The invention thus provides that the swivelling device is provided with an operating device which is articulated, in a space-saving manner, at the upper end of the upper scraper blade between a permanently installed part of the construction machine and the upper part of the scraper blade. The operating device is therefore independent of lifting cylinders of the scraper blade and can swivel the scraper blade about a first swivelling axis when the scraper blade is disengaged from the lateral retaining devices. The arrangement of the operating device enables a large swivelling angle, since the scraper blade can be swivelled about 90° and more. A small swivelling radius is achieved at the same time because the lifting cylinders, and thus also the scraper blade itself, are not required to provide any additional lifting path for an additional swivelling movement even after completion of the actual lifting movement. A low design height of the swivelling device is realized in that the operating device is preferably arranged horizontally. In addition, swivelling of the scraper blade is effected fully automatically without requiring any manual operation.

The operating device may be arranged essentially orthogonally to the scraper blade. As a general rule, the swivelling device is to not increase the design height of the scraper device.

It is preferably provided that the retaining devices and the scraper blade are provided with locking means arranged parallel to the axis of the milling drum, where, on the blade side, the said locking means show at least one first locking means each at the two vertical lateral edges of the scraper blade which, on the machine side, interact with second locking means adapted to the first locking means when the scraper blade is in operating position or is not fully raised.

The operating device at the upper part of the scraper blade engages with an articulation of the scraper blade below the swivelling axis. As the operating device engages with the upper part of the scraper blade below the swivelling axis, the swivelling device may be of especially compact design. For swivelling, the operating device presses against the scraper blade, so that the same can be swivelled about the swivelling axis.

Relative to the articulation of the scraper blade, the swivelling axis is arranged vertically higher and offset horizontally towards the rear in relation to the scraper blade, i.e. offset towards the rear in the direction pointing away from the milling drum.

The machine-side articulation of the operating device is arranged at the permanently installed part of the construction machine also below a horizontal plane through the swivelling axis.

The articulation of the scraper blade is mounted in the plane of the upper part of the scraper blade or at a small distance from this plane.

The aforementioned features enable favourable leverage ratios and a small swivelling radius due to the fact that the two parts of the scraper blade are entirely moved together, and that a separate swivelling device is provided. In addition, a large swivelling angle of more than 90° is achieved simultaneously with a compact design.

The swivelling axis is supported at a permanently installed part of the construction machine, in particular at the machine frame or a drum casing surrounding the milling drum and attached at the machine frame.

In one embodiment, it is provided that the lower part of the scraper blade is engaged with lateral retaining devices when in operating position, and that a swivelling device can swivel the scraper blade about the swivelling axis when the lower part of the scraper blade is disengaged from the lateral retaining devices.

In addition, it may be provided that the retaining devices on the machine side are provided, on both sides of the scraper blade, with at least one each projection, which projects horizontally in the direction of the scraper blade and is engaged with a vertically running strip at the corresponding lateral edge of the lower part of the scraper blade when the scraper blade is in operating position or is not fully raised.

The projection preferably consists of a rotatable sliding block which is mounted to rotate about an axis running parallel to the axis of the milling drum. The sliding block has a preferably cuboid shape with quadratic cross-section.

In one embodiment, it is provided that the lower part of the scraper supports itself at the sliding blocks towards the rear when seen in the direction of travel.

The lower part is preferably raisable in relation to the upper part by means of a lifting device, until the lower part is disengaged from the lateral retaining devices. For swivelling of the scraper blade, the lower part of the scraper blade is raised until it has moved beyond the sliding blocks provided on both sides. When the scraper blade is moved back into the operating position, these steps are correspondingly carried out in the reverse sequence. In the process, the lower part of the scraper blade threads in again behind the two-sided sliding blocks. For this purpose, the guides of the scraper blade are provided with chamfers or roundings respectively, with the sliding blocks themselves being supported in a rotating fashion. This support also brings about an as large contact surface as possible and thus low surface pressures, which lead to low wear and tear.

Vertically running strips interacting with the sliding blocks are arranged at the lateral edges of the lower part of the scraper blade. These strips are bevelled at their bottom edge towards the scraper blade.

According to an alternative, it may be provided that the projections towards the outside are retractable automatically in order to release the lower part of the scraper blade when the lower part of the scraper blade is raised to a sufficient extent. In this alternative, it may also be provided that the upper part of the scraper, and not the lower part, supports itself at the sliding blocks towards the rear when seen in the direction of travel.

In an additional embodiment, it is provided that the upper part of the scraper blade is engaged with lateral retaining devices when in operating position, and that a swivelling device can swivel the scraper blade about the swivelling axis when the upper part of the scraper blade is disengaged from the lateral retaining devices.

It may be provided that the locking means are unlockable in order to release the upper part of the scraper blade when the lower part of the scraper blade is raised to a sufficient extent or is fully raised.

The lower part is preferably raisable in relation to the upper part by means of a lifting device, until the upper part is disengaged from the lateral retaining devices.

In this embodiment, it may be provided that the lower part of the scraper blade is provided with an unlocking device which, when raising the lower part of the scraper blade, unlocks the locking means after a pre-determined lifting path so that the scraper blade is then capable of being swivelled because of the unlocking process.

In an additional embodiment, it may be provided that the retaining devices on both sides of the scraper blade are provided, as a first locking means, with at least one each projection on the blade side which projects parallel to the axis of the milling drum in the direction of the lateral walls running orthogonally to the scraper blade, with the said projection engaging with a recess, as a second locking means, in the lateral walls when the scraper blade is in operating position or is not fully raised.

Additional advantageous embodiments can be gathered from the additional dependent claims.

The invention also relates to a construction machine, in particular an automotive road milling machine, with the scraper device according to the invention.

In the following, embodiments of the invention are explained in more detail with reference to the drawings.

DESCRIPTION OF THE PREFERRED EMBODIMENTS

Figure 1:
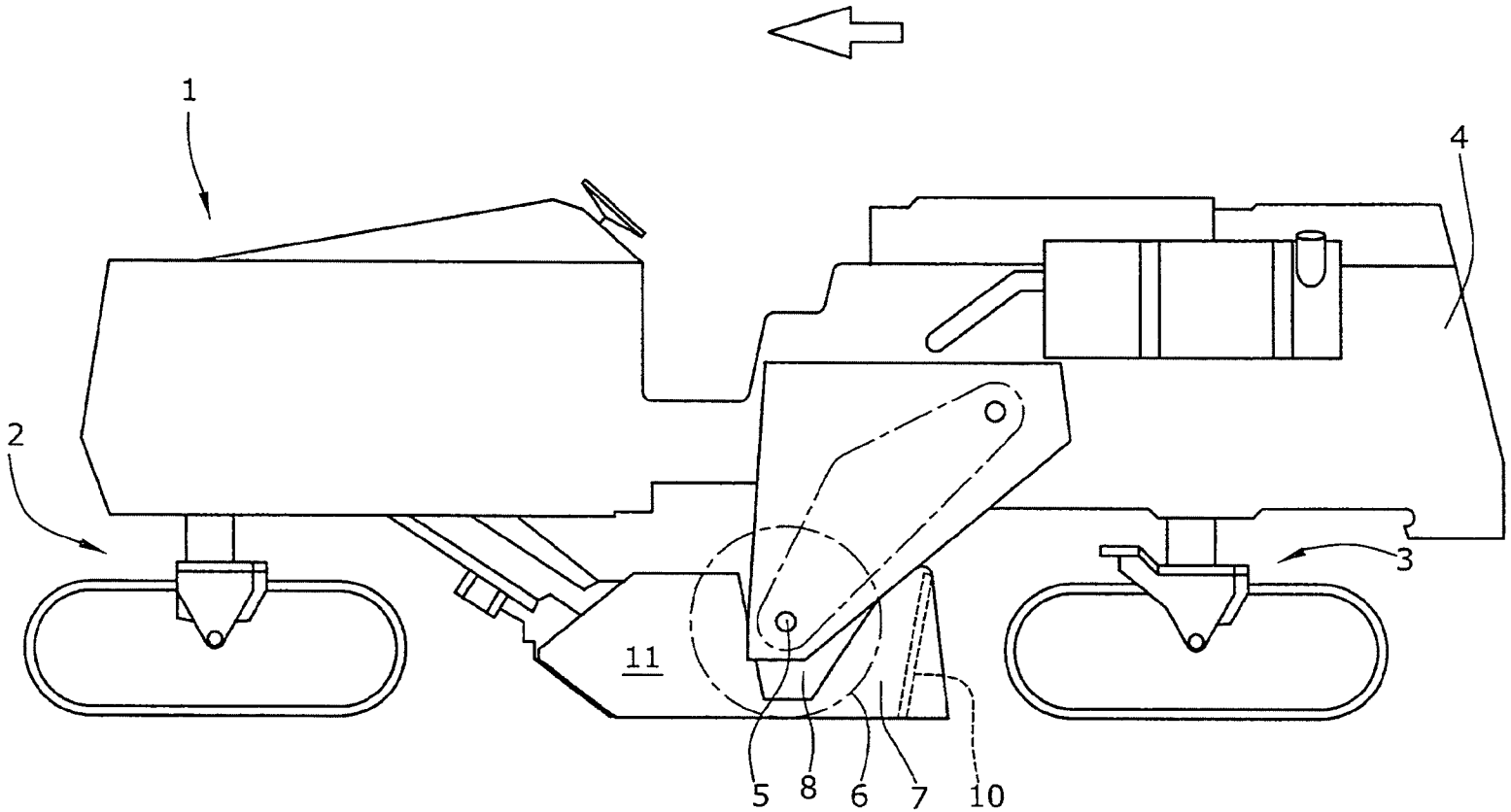
FIG. 1 is an automotive road milling machine with a scraper device according to the invention.

FIG. 1 shows an automotive road milling machine 1 in the design of a large milling machine, in which a milling drum 6 is mounted between front and rear travel drive units 2, 3 with a milling drum axis 5 in lateral walls 8 of the machine frame 4.

The milling drum 6 is surrounded by a drum casing 7 attached to the machine frame 4, the said drum casing 7 being provided with, at the rear end when seen in the direction of travel, a scraper device with a two-part scraper blade 10. The lower part 12 of the scraper blade 10 can glide over the ground surface 9 milled off by the milling drum 6 during operation, with the lower part 12 of the scraper blade 10 being adjustable in height relative to the milling drum 6.

It goes without saying that the scraper device with a two-part scraper blade 10 is also suitable for use in other road milling machines of different design.

In addition to the side walls 8, a height-adjustable side plate 11 may additionally be provided as edge protection for the milling edge.

Figure 2:
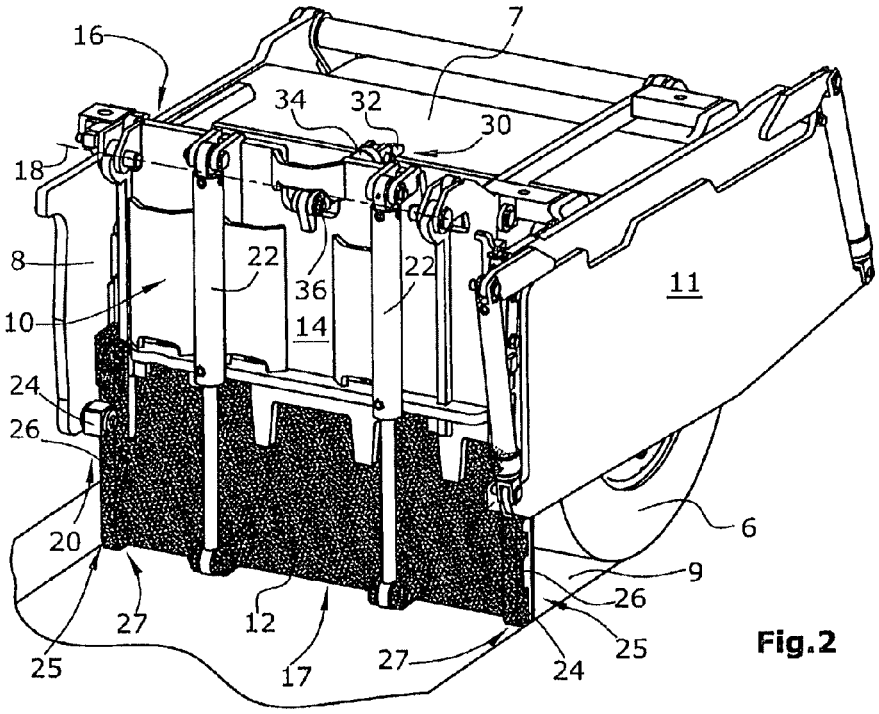
FIG. 2 is a first embodiment of a scraper device in operating condition.

FIG. 2 shows a first embodiment of a scraper device with a two-part scraper blade 10, in which the upper part 14 of the scraper blade 10 is attached, at the upper end 16, in an articulated fashion to swivel about a swivelling axis 18 parallel to the axis of the milling drum 5.

In operating position, the scraper blade 10 is engaged with lateral retaining devices 20 in the lateral walls 8, which retain the scraper blade 10 in a position running essentially orthogonally to the ground surface 9. In the embodiment of FIG. 1, the lower part 12 of the scraper blade 10 is engaged with sliding blocks 24, which are mounted to rotate in the lateral walls 8 on both sides of the lower part 12 of the scraper blade 10.

The lower part 12 is provided with one sliding surface 26 each on its vertical lateral edges 25, which are engaged with the sliding blocks 24 in a full-surface fashion.

For this purpose, the sliding blocks are designed in cuboid shape, and in quadratic shape in particular in the cross-section, and are mounted to rotate in the lateral walls 8.

When the lower part 12 of the scraper blade 10 is raised in relation to the upper part 14 by means of the lifting device 22, then the lower part 12, when in the highest position, is disengaged from the sliding blocks 24, so that the scraper blade 10 as a whole is released for swivelling.

A swivelling device 30 can then swivel the scraper blade 10 about the swivelling axis 18, with the swivelling device 30 being articulated, at the upper end 16 of the upper part 14, with an operating device 34 comprising a piston-cylinder unit. The operating device 34 is articulated, on the machine side, at a permanently installed part 32, for example, at the drum casing 7, and extends essentially horizontally to an articulation 36 at the upper end 16 of the upper part 14 of the scraper blade 10, so that the scraper blade 10 can be swivelled upwards by at least 90° when a pressure force is applied by the operating device 34.

As the lower part 12 of the scraper blade 10 is fully raised, the scraper blade 10 has only approximately half the height, so that the swivelling radius of the scraper blade 10 is reduced while a large swivelling angle is made possible at the same time.

When the scraper blade 10 is swivelled back into the operating position, the lower part 12 can be moved downwards so that the lower part 12 can then thread in again in front of the sliding blocks 24 when seen in the direction of travel. Threading in is facilitated by the fact that the vertically running sliding surfaces 26 are bevelled or rounded at their lower edges 27 towards the scraper blade 10, and that the sliding blocks 24 are mounted in a rotating fashion. The sliding surfaces 26 may also run slightly conically, tapering in downward direction, in order to facilitate threading in as well.

The rotatable sliding block 24 with a quadratic cross-section permits full-surface contact with the sliding surface 26, so that reduced wear and tear results from the full-surface contact.

The sliding blocks 24 act as locking means when the scraper blade 10 is in the operating position.

The operating device 34, at the upper part 14 of the scraper blade 10, preferably engages with the articulation 36 below the swivelling axis 18 of the scraper blade 10. It is understood that two operating devices 34 with two articulations 36, forming a second swivelling axis, may also be provided.

The swivelling axis 18 is therefore arranged vertically higher relative to the articulation 36, and offset horizontally towards the rear relative to the direction of travel. In this way, the swivelling device 30 requires only a low design height where, due to the low point of application of the operating device 34, the entire swivelling device 30 does not project vertically in upward direction in relation to the upper part 14 of the scraper blade 10.

The articulation 36 of the scraper blade 10 is preferably arranged in the plane of the upper part 14 of the scraper blade 10 or at a small distance from this plane.

Figure 3:
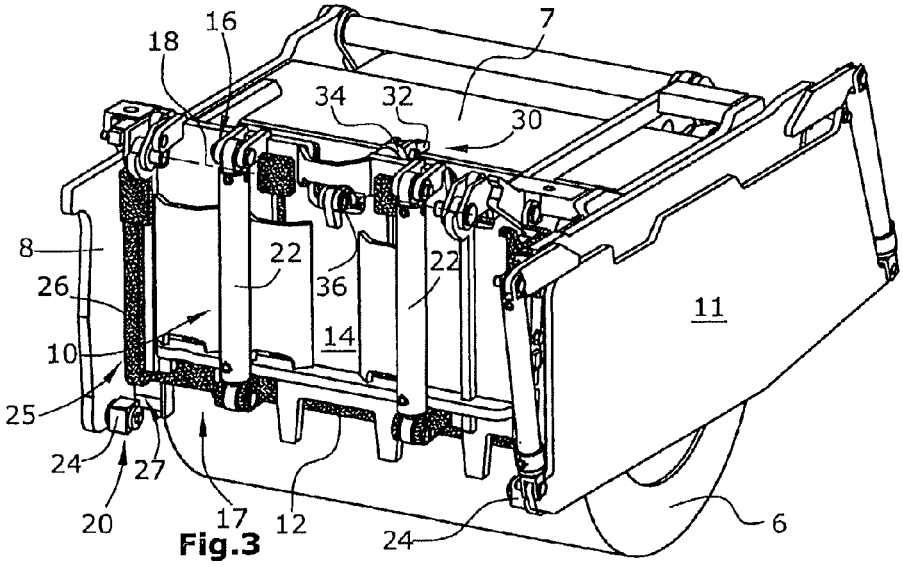
FIG. 3 is a scraper device according to FIG. 2 with the raised lower scraper part in unlocked position.
Figure 4:
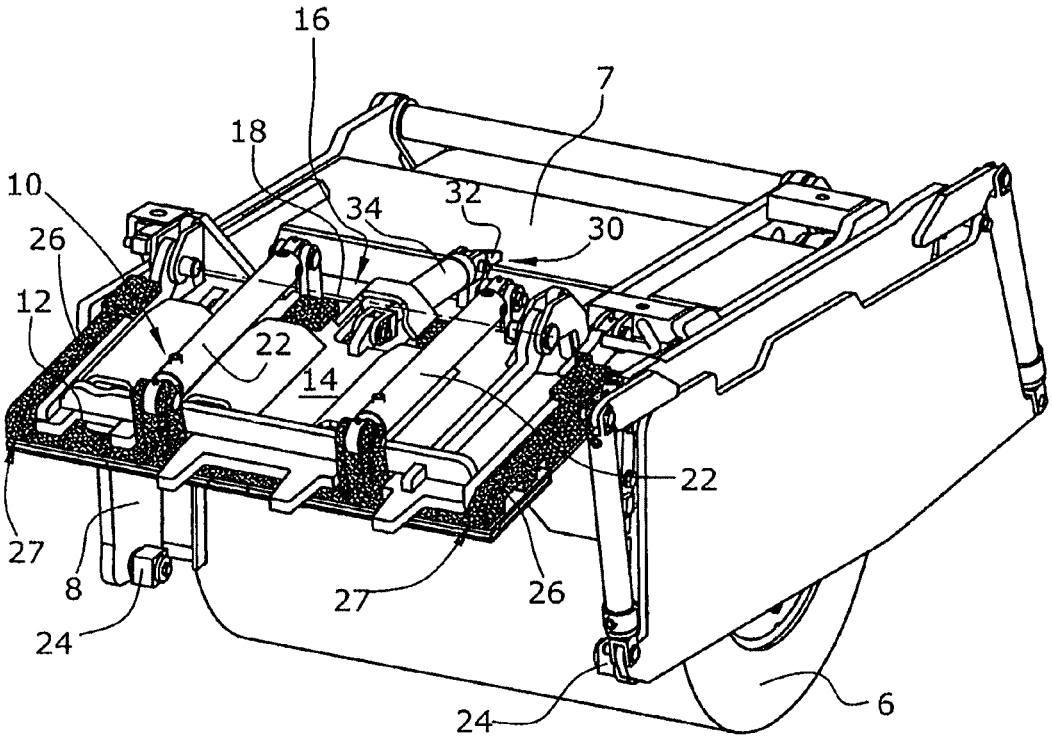
FIG. 4 is a scraper device according to FIG. 2 in raised and swivelled position.
Figure 5:
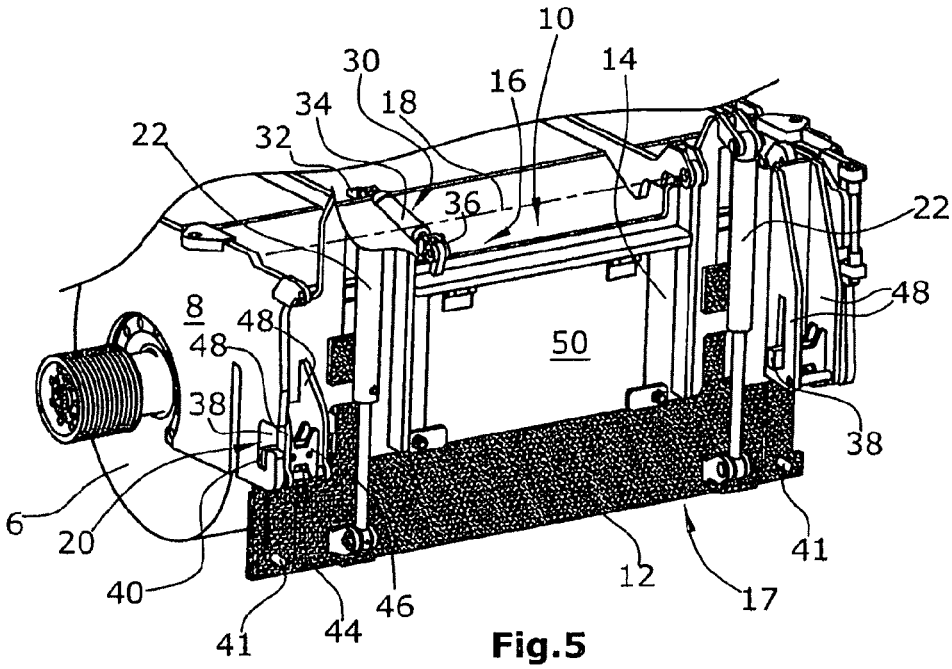
FIG. 5 is a second embodiment of a scraper device in operating condition.
Figure 6:
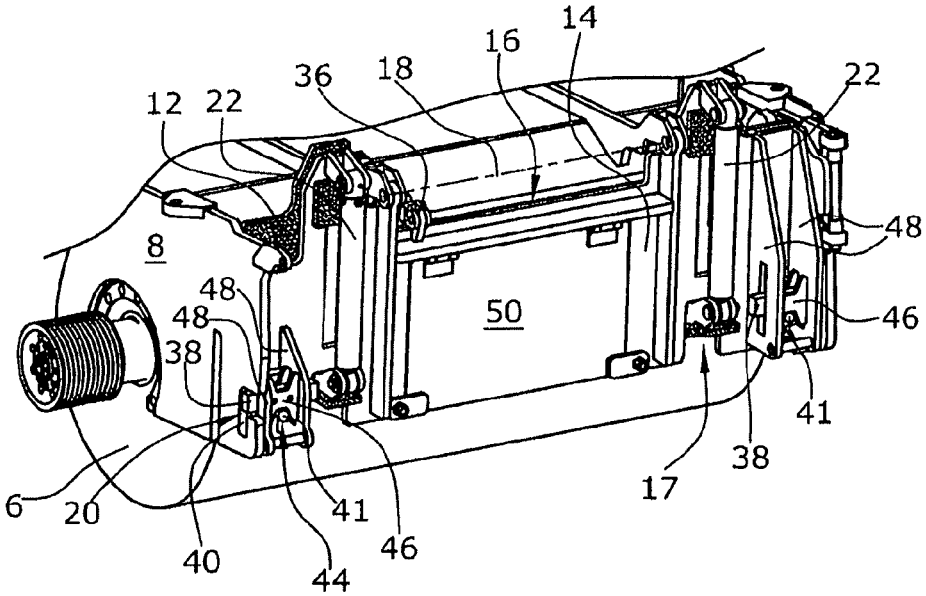
FIG. 6 is a scraper device according to FIG. 5 with the raised lower scraper part in unlocked position.
Figure 7:
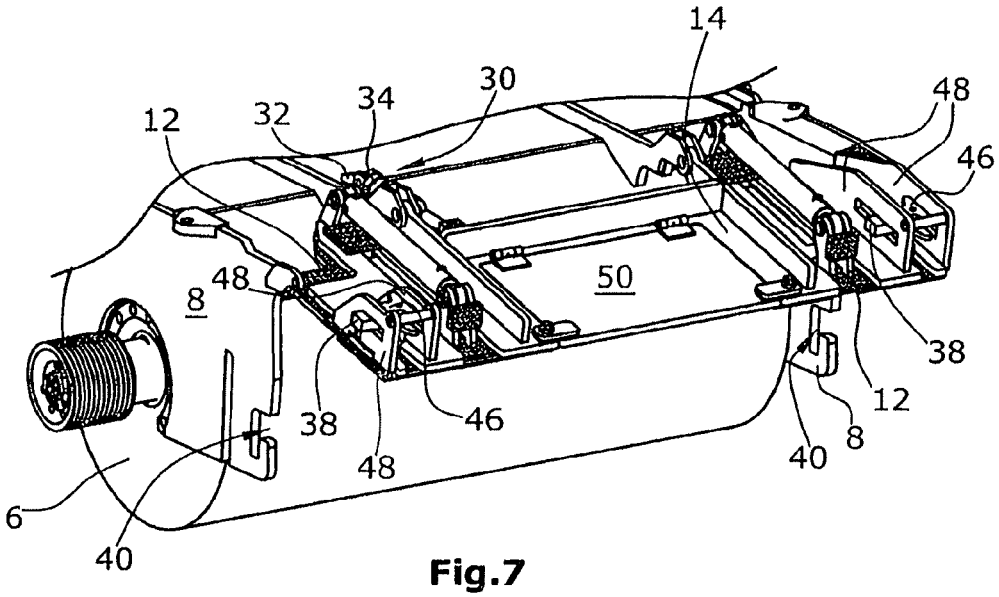
FIG. 7 is a scraper device according to FIG. 5 in raised and swivelled position.

In the embodiments of FIGS. 5 to 7, the swivelling device 30 and the swivelling axis 18, as well as the lifting device 22 are arranged in essentially the same fashion as in the embodiments of FIGS. 2 to 4.

The difference therefore essentially concerns the design of the retaining devices 20. These retaining devices consist of locking bolts 38 that are provided on both sides of the upper part 14 of the scraper blade 10, at the lower end of the upper part 14, with the said locking bolts 38 mounted in a movable fashion vertically in the upper part 14 of the scraper blade 10. The locking bolts 38 engage with corresponding bayonet-type recesses 40 in the lateral walls 8.

Carriers 41 attached at the lower part 12 of the scraper blade 10 lift the locking bolts 38 when the lower part 12 of the scraper blade 10 is in its raised position. Lifting of the locking bolts 38 causes these to be lifted out of the locking part of the recess 40, so that the operating device 34 of the swivelling device 30 can swivel the scraper blade 10 about 90° or about more than 90° respectively.

The carriers 41 at the lower part 12 of the scraper blade 10 consist of round bolts projecting orthogonally from the lower part 12 and running essentially horizontally. The locking bolts 38, which are supported in a guide of the upper part 14 of the scraper blade and are designed in a vertically movable fashion, are provided with recesses 44 open towards the bottom in their guiding plates 46 running parallel to the scraper blade 10, with carriers 41 being able to engage with the said recesses 44 in order to lift and to unlock the locking bolts 38.

The locking bolts 38 are guided between vertical guiding walls 48, which project orthogonally from the upper part 14 of the scraper blade 10, in such a manner that the locking bolts 38 cannot get jammed.

In addition, the upper part 14 of the scraper blade 10 can be provided with a flap 50 which can be opened in the operating position of the scraper blade 10 in order to be able to deposit a part of the excavated material in the milled track, if required.

In both embodiments, the lifting device 22 engages, on the one hand, with the upper end 16 of the upper part 14 of the scraper blade 10 and, on the other hand, with the lower end 17 of the lower part 12 of the scraper blade 10.

In both embodiments, the scraper blade 10 runs essentially orthogonally to the ground surface 9, i.e. vertically or slightly inclined by up to approx. 15° towards the milling drum, as can be seen from FIG. 1.

Although a preferred embodiment of the invention has been specifically illustrated and described herein, it is to be understood that minor variations may be made in the apparatus without departing from the spirit and scope of the invention, as defined by the appended claims.

What is claimed is:

1. A construction machine, comprising:

a machine frame;

a milling drum connected to the machine frame to rotate about a milling drum axis;

a scraper blade located behind the milling drum with reference to a direction of travel of the construction machine;

an actuator assembly configured to lift the scraper blade linearly relative to the machine frame through an adjustment range and to swivel the scraper blade relative to the machine frame after the scraper blade is raised past the adjustment range; and a retainer configured to allow linear movement of the scraper blade relative to the machine frame through the adjustment range while preventing swiveling motion of the scraper blade relative to the machine frame in the adjustment range, and configured to automatically release to allow swiveling motion of the scraper blade relative to the machine frame after the scraper blade is raised past the adjustment range.

2. The construction machine of claim 1, wherein:

the retainer includes a first locking part and a second locking part, the first locking part extending parallel to the milling drum axis from a lateral edge of the scraper blade, the second locking part being associated with the machine frame, the first locking part interacting with the second locking part when the scraper blade is in the adjustment range.

3. The construction machine of claim 2, wherein:

the first locking part includes a locking bolt; and the second locking part includes a locking recess, the locking bolt being received in the locking recess when the scraper blade is in the adjustment range.

4. The construction machine of claim 3, wherein:

the locking bolt is automatically retractable from the locking recess when the scraper blade is raised past the adjustment range.

5. The construction machine of claim 1, wherein:

when the scraper blade is in the adjustment range the retainer engages the scraper blade; and when the scraper blade is raised past the adjustment range the scraper blade is disengaged from the retainer.

6. The construction machine of claim 5, wherein:

the scraper blade includes a lateral edge and a linearly extending sliding surface defined adjacent the lateral edge; and the retainer includes a projection projecting from the frame and engaging the sliding surface when the scraper blade is in the adjustment range.

7. The construction machine of claim 6, wherein:

the projection comprises a sliding block rotatable about a horizontal axis.

8. The construction machine of claim 7, wherein:

the sliding block has a quadratic cross-section.

9. The construction machine of claim 6, wherein:

the sliding surface is tapered toward a lower edge of the scraper blade.

10. A construction machine, comprising:

a machine frame;

a milling drum connected to the machine frame to rotate about a milling drum axis;

a scraper blade located behind the milling drum with reference to a direction of travel of the construction machine;

an actuator assembly configured to lift the scraper blade linearly relative to the machine frame through an adjustment range and to swivel the scraper blade relative to the machine frame after the scraper blade is raised past the adjustment range; and a retainer including a first locking part, a second locking part, and an automatic release, the first locking part extending parallel to the milling drum axis from a lateral edge of the scraper blade, the second locking part being associated with the machine frame, the first locking part interacting with the second locking part when the scraper blade is in the adjustment range, the automatic release releasing the first locking part from the second locking part when the scraper blade is raised past the adjustment range.

11. The construction machine of claim 10, wherein:

the first locking part includes a locking bolt; and the second locking part includes a locking recess, the locking bolt being received in the locking recess when the scraper blade is in the adjustment range.

12. The construction machine of claim 11, wherein:

the automatic release is configured to automatically retract the locking bolt from the locking recess when the scraper blade is raised past the adjustment range.

13. A construction machine, comprising:

a machine frame;

a milling drum connected to the machine frame to rotate about a milling drum axis;

a scraper blade located behind the milling drum with reference to a direction of travel of the construction machine;

an actuator assembly configured to lift the scraper blade linearly relative to the machine frame through an adjustment range and to swivel the scraper blade relative to the machine frame after the scraper blade is raised past the vertical adjustment range; and a retainer engaging the scraper blade when the scraper blade is in the adjustment range, the retainer being automatically disengaged from the scraper blade when the scraper blade is above the adjustment range.

14. The construction machine of claim 13, wherein:

the scraper blade includes a lateral edge and a linearly extending sliding surface defined adjacent the lateral edge; and the retainer includes a projection projecting from the frame and engaging the sliding surface when the scraper blade is in the adjustment range.

15. The construction machine of claim 14, wherein:

the projection comprises a sliding block rotatable about a horizontal axis.

16. The construction machine of claim 15, wherein:

the sliding block has a quadratic cross-section.

17. The construction machine of claim 14, wherein:

the sliding surface is tapered toward a lower edge of the scraper blade.

18. A method of operating a scraper blade of a construction machine having a working drum supported from a machine frame, the method comprising:

(a) adjusting an operating depth of the scraper blade within an adjustment range;

(b) moving the scraper blade to an open position to allow access to the working drum by pivoting the scraper blade about a pivotal axis relative to the machine frame after the scraper blade is raised past the adjustment range;

(c) retaining the scraper blade against pivoting motion during step (a); and (d) automatically releasing the scraper blade to allow pivoting motion when the scraper blade is raised past the adjustment range.

19. The method of claim 18, wherein:

during step (c), the scraper blade is retained in a position in a range of from vertical to an inclination of about 15 degrees relative to vertical.

20. The method of claim 18, wherein:

in step (b) the scraper blade pivots through an angle of about 90 degrees or more.

21. The method of claim 18, wherein:

in step (c) a locking bolt extending laterally from the scraper blade is received in a locking recess defined in the machine frame.

22. The method of claim 21, wherein:

step (d) further comprises automatically retracting the locking bolt from the locking recess when the scraper blade is raised past the adjustment range.

23. The method of claim 18, wherein:

step (c) further comprises engaging the scraper blade with a retainer attached to the machine frame when the scraper blade is in the adjustment range; and step (d) further comprises disengaging the scraper blade from the retainer when the scraper blade is raised above the adjustment range.

24. The method of claim 23, wherein:

in step (c) a linearly extending sliding surface of the scraper blade engages the retainer.

25. The method of claim 24, wherein:

in step (c) the retainer comprises a sliding block rotatable about a horizontal axis, and a planar surface of the sliding block slidingly engages the sliding surface of the scraper blade.

* * * * *